US009175514B2

(12) United States Patent
Ducornetz et al.

(10) Patent No.: US 9,175,514 B2
(45) Date of Patent: Nov. 3, 2015

(54) TUBULAR ACTUATOR FOR DRIVING A ROLLER BLIND

(75) Inventors: Béatrice Ducornetz, Cluses (FR); Denis Magli, Taninges (FR)

(73) Assignee: SOMFY SAS, Cluses (FR)

( * ) Notice: Subject to any disclaimer, the term of this patent is extended or adjusted under 35 U.S.C. 154(b) by 1540 days.

(21) Appl. No.: 12/774,080

(22) Filed: May 5, 2010

(65) Prior Publication Data

US 2010/0282890 A1 Nov. 11, 2010

(30) Foreign Application Priority Data

May 5, 2009 (FR) ..... 09 02150

(51) Int. Cl.

| | |
|---|---|
| ***B65H 16/06*** | (2006.01) |
| ***A47H 1/00*** | (2006.01) |
| ***E06B 9/72*** | (2006.01) |
| ***E06B 9/174*** | (2006.01) |
| ***E06B 9/50*** | (2006.01) |

(52) U.S. Cl.

CPC . *E06B 9/72* (2013.01); *E06B 9/174* (2013.01); *E06B 9/50* (2013.01)

(58) Field of Classification Search

CPC ..... E06B 9/72; E06B 9/50; E06B 9/174
USPC ..... 242/390, 390.8, 390.9, 599, 599.3; 310/83, 93, 98; 160/310
See application file for complete search history.

(56) References Cited

U.S. PATENT DOCUMENTS

| | | | | |
|---|---|---|---|---|
| 4,467,250 | A * | 8/1984 | Thomasson | 318/436 |
| 4,496,865 | A * | 1/1985 | Allen et al. | 310/80 |
| 4,665,965 | A * | 5/1987 | Pasquier et al. | 160/310 |
| 4,858,244 | A * | 8/1989 | Nordhaus | 372/77 |
| 5,105,871 | A * | 4/1992 | Baud et al. | 160/310 |
| 5,123,474 | A * | 6/1992 | Smith | 160/310 |
| 5,711,360 | A * | 1/1998 | Viotte | 160/310 |
| 5,803,150 | A * | 9/1998 | Boiteau | 160/310 |

(Continued)

FOREIGN PATENT DOCUMENTS

| | | |
|---|---|---|
| DE | 20 2007 001 705 U | 6/2007 |
| DE | 20 2007 005 138 U | 8/2007 |

(Continued)

OTHER PUBLICATIONS

Search Report issued Feb. 26, 2010 by French Patent Office for priority French application FR 09 02150.

*Primary Examiner* — William A Rivera
(74) *Attorney, Agent, or Firm* — Frommer Lawrence & Haug LLP

(57) ABSTRACT

Tubular actuator (1) for driving a windable element in a building, comprising:

in a tube (3) having a longitudinal axis (X-X'), a reduction gear and an output shaft (4) at a first end of the tube and a fixed-point (2) in two portions at a second end of the tube, the fixed-point comprising a first portion (20; 20') at least partially outside the tube and a second portion (40; 40') assembled in the tube, wherein the first portion comprises at least one torque and weight-bearing axial extension, this torque and weight-bearing axial extension being capable of being inserted into at least one recess of the second portion and being locked in translation along the longitudinal axis relative to the tube of the actuator by a first locking means (35, 37, 38).

10 Claims, 3 Drawing Sheets

(56) References Cited

U.S. PATENT DOCUMENTS

| | | | | |
|---|---|---|---|---|
| 6,564,777 | B2 * | 5/2003 | Rahardja et al. | 123/467 |
| 6,628,029 | B2 * | 9/2003 | Astegno | 310/105 |
| 6,782,938 | B2 * | 8/2004 | Colson et al. | 160/121.1 |
| 7,237,592 | B2 * | 7/2007 | Arnoux et al. | 160/310 |
| 7,299,915 | B2 * | 11/2007 | El-Ibiary | 198/788 |
| 7,726,379 | B2 * | 6/2010 | Beau | 160/310 |
| 8,009,433 | B2 * | 8/2011 | Ares | 361/752 |
| 8,253,288 | B2 * | 8/2012 | Lagarde et al. | 310/77 |
| 8,258,993 | B2 * | 9/2012 | Inoue et al. | 341/176 |
| 2003/0000657 | A1 * | 1/2003 | Dupielet et al. | 160/310 |
| 2005/0103450 | A1 * | 5/2005 | Beau | 160/168.1 R |

FOREIGN PATENT DOCUMENTS

| | | | |
|---|---|---|---|
| FR | 2 840 012 | A | 11/2003 |
| WO | WO 2006/045724 | A | 5/2006 |
| WO | WO 2008/003765 | A | 1/2008 |
| WO | WO 2009/016601 | A | 5/2009 |

* cited by examiner

Fig. 1
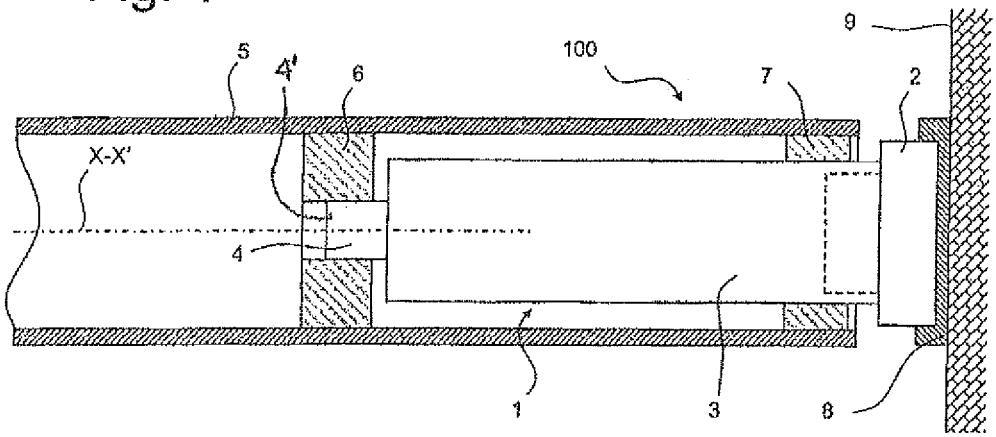
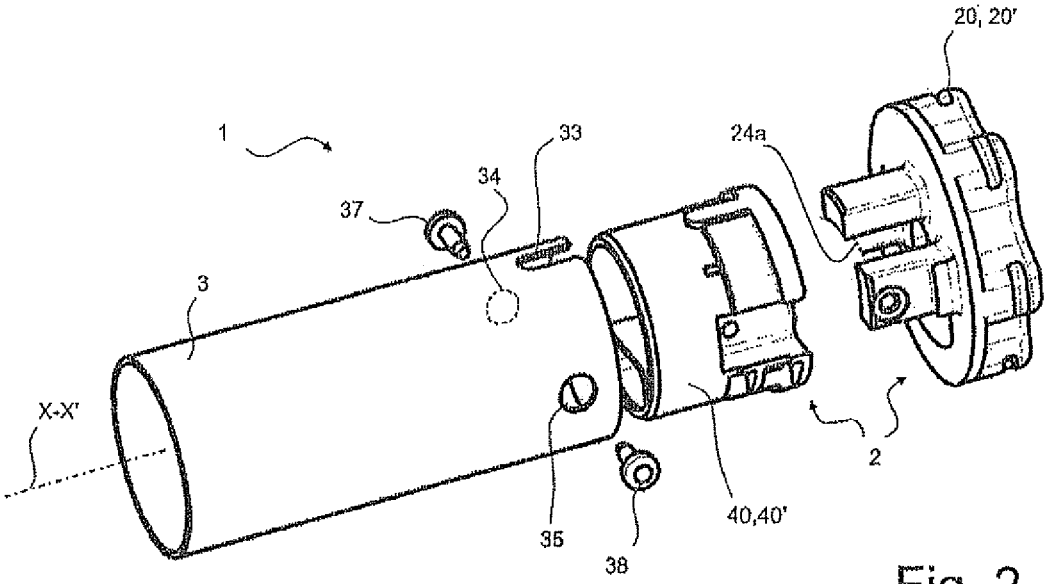
Fig. 2
Fig. 7
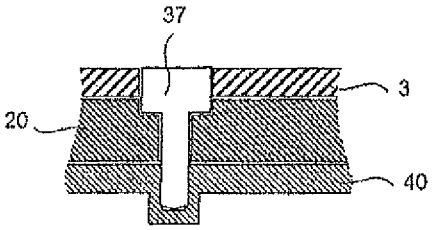

TUBULAR ACTUATOR FOR DRIVING A ROLLER BLIND

This application claims priority of French Patent Application Number FR 09 02150 filed May 5, 2009, the disclosure of which is incorporated herein by reference.

The invention relates to a tubular actuator for driving a windable element in a building, such as an awning, a sunscreen or a picture-projection screen, a roller blind. The tubular actuator is inserted into the winding tube on which the windable element is wound.

It comprises an end part connected to a portion of the frame, which supports a portion of the weight of the actuator, of the winding tube and of the windable element, typically half of the weight, and which wholly supports the torque of the actuator. This end part is often called the "fixed-point" or else the "head" of the actuator.

The head of the actuator must therefore be designed so as to satisfy these mechanical requirements, but also by minimizing its size in the axial direction: specifically, the windable element cannot be wound onto the head, and the width of the head therefore reduces by the same amount the width of the latter if no specific housing is provided in the frame.

Moreover, the head is connected to the frame by an attachment accessory capable of being firmly attached to the frame, for example with the aid of bolts on a metal frame or with the aid of plugged screws. The connection of the head to the attachment accessory is preferably removable, that is to say easily locked or unlocked, so as to make easier the installation or the maintenance of the windable element or of the actuator. Accordingly, the various manufacturers have designed specific attachment accessories, comprising for example means for elastic clipping and shapes adapted to the simultaneous bearing of weight and of torque. Such an attachment accessory is described in document WO 2008/3765 (reference 2 in FIG. 1). It is adapted to receive an actuator comprising a fixed point (reference 4) and a single portion.

An actuator manufacturer must therefore preferably offer a wide range of actuators, which differ only in the shape of the head. The result of this is a large number of references, which complicates logistics and adds to the costs. If the actuator manufacturer seeks to rationalize his offering and offers only a single type of head, he transfers the problem to the manufacturers making windable elements and makes them adopt an attachment solution that is not necessarily optimized for their products.

Finally, the head of the actuator must most frequently satisfy the requirements of watertightness associated with a possible use of the actuator on the outside of the building or in wet locations.

The actuator is tested in production and guaranteed by its manufacturer. It is clear that this guarantee relates to the whole of the fixed point, and that a solution of interchangeability of the latter becomes particularly risky if it escapes from the industrial environment, for example by being able to be produced on a work site. The interchangeability of the fixed point requires at least one intervention in a workshop, in an environment agreed between the manufacturer making the actuator and the manufacturer incorporating the actuator into his own product comprising the winding tube and/or the windable element.

Patent application WO 2009/016601 describes a head or fixed point of a tubular actuator, this head or fixed point being produced in two portions. A first portion is almost wholly inserted into the tube of the actuator and comprises means for stopping in translation in the tube, which become locked by the insertion of a second portion. Interchangeability can be obtained by the proposed solution. However, the latter seems particularly fragile with respect to the requirements of the forces mentioned, without enhancing the role of the attachment means not described in this document. The solution proposed in this patent application is particularly valuable in that the locking of the means for stopping in translation is simple and requires no tools, and the same applies for unlocking, which tells against the safety objectives mentioned above.

Patent application WO 2006/045724 or else the registered design DE 20 2007 005 138 describe in a manner similar to patent FR 2 840 012 a fixed point comprising mechanical or electronic means for controlling the stopping of the actuator (torque detection, rotation counting etc.) and means for mechanical and electric connection with the tubular portion of the actuator. In the German registered design, the fixed point comprises a first retractable portion, referenced 9 and comprising the control means, and a second portion referenced 2 linked to the tube of the actuator.

In these documents, interchangeability is not designed to allow adaptation to various types of attachment accessories, but to allow either the final mounting of the actuator on the work site, or to allow a deferred choice of the control means.

The invention therefore proposes in particular a simple and economic solution for the interchangeability of heads of the actuators that satisfies the mechanical and safety requirements mentioned above.

The object of the invention is to provide an actuator that remedies the above drawbacks and improves the actuators of the prior art. In particular, the invention makes it possible to produce an actuator that is simple and economical and allows an interchangeability of head that satisfies the mechanical and safety requirements. The invention also relates to an installation comprising such an actuator.

According to the invention, the tubular actuator for driving a windable element in a building comprises:

in a tube (3)having a longitudinal axis (X-X'), a reduction gear (4')and an output shaft (4) at a first end of the tube and a fixed-point (2) in two portions at a second end of the tube, the fixed-point comprising a first portion (20: 20') at least partially outside the tube and a second portion (40: 40') assembled in the tube. The first portion comprises at least one torque and weight-bearing axial extension (24,24'25, 25'), this torque and weight-bearing axial extension being capable of being inserted into at least one recess (44, 44',45,45') of the second portion and being locked in translation along the longitudinal axis relative to the to of the actuator by a first locking means (27,28,34,35, 37,38,28'34,35,37,38).

The first locking means can be attached to the first portion.

In this case, the first locking means may comprise a screw, a tapping in the first portion, a screw through-hole in the second portion and a screw through-hole in the tube.

The first locking means may be attached to the second portion.

In this case, the first locking means may comprise a screw, a tapping in the second portion, a screw through-hole in the first portion and a screw through-hole in the tube.

The second portion may be locked in translation along the longitudinal axis relative to the tube of the actuator by a second locking means attached to the second portion.

The second locking means may not lock the translation along the longitudinal axis of the first portion relative to the tube of the actuator.

The second locking means may comprise a screw, a tapping in the second portion, a screw through-hole in the tube and, if necessary an open axial orifice for a screw to pass through in the first portion.

The at least one recess may be a peripheral recess.

According to the invention, the home-automation installation comprises a tubular actuator previously defined.

The invention will be better understood on reading the following description given only as an example and made with reference to the appended drawings in which:

FIG. 1 represents an installation comprising a tubular actuator according to the invention.

FIG. 2 represents a partial exploded view of a tubular actuator according to the invention.

FIG. 7 is a local and longitudinal section at an assembly of the first fixed-point portion, of the second fixed point portion and of the actuator.

Figure 3:
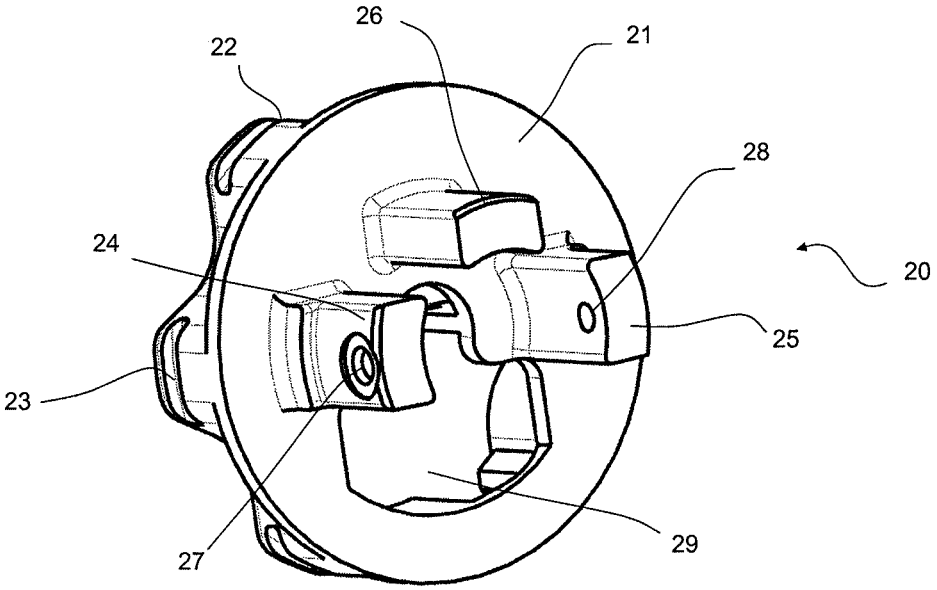
FIG. 3 represents a first embodiment of a first fixed point portion.

FIG. 1 represents an installation 100 comprising a tubular actuator 1. The tubular actuator comprises a fixed-point 2, a tubular body 3 and an output shaft 4 that can rotate on the axis X-X' of the tubular body of the actuator. The output shaft is connected to a winding tube 5, in which the actuator is engaged, by a drive wheel 6. A bearing 7 allows the winding tube to be guided in rotation on the tubular body of the actuator. An attachment accessory 8 connects the fixed point to a frame 9. A windable element, not shown, is attached by one end to the winding tube. The attachment accessory is attached to the frame, for example a structure of a building. It is preferably attached directly to this frame. Moreover, the attachment accessory is designed to receive the fixed point of the actuator. It has, for example, shapings for this purpose. The attachment accessory thus makes it possible to attach the fixed-point indirectly to the frame.

A dotted line represents a part of the fixed-point 2 that is engaged in the tubular body 3.

FIG. 2 represents a partial exploded view of a tubular actuator according to the invention.

The fixed-point 2 comprises a first portion, referenced 20 or 20' depending on the embodiments, and a second portion, referenced 40 or 40' depending on the embodiments.

The first portion is essentially outside the tube and comprises a lesser direct contact with the latter than that of the second portion. A thin dotted line 24*a* delimits a masked portion of the first portion. This masked portion differs depending on the embodiment.

It is this first portion for which the interchangeability is provided. The portion outside the tube can therefore have a large variety of shapes, depending on the requirements of the manufacturers of windable elements.

The tube 3 is preferably made of steel. In particular it comprises an orifice 33 allowing the second portion to be prevented from rotating, a first screw hole 34 capable of allowing the body of a first screw 37 to pass through and a second screw hole 35 capable of allowing the body of a second screw 38 to pass through.

In this embodiment, the first and the second screws are used as locking means between the tube and the second portion.

X-X' indicates the main axis of the tube which from now onwards defines an axial direction.

FIG. 3 represents a first embodiment of a first portion 20 of the fixed-point.

The first portion comprises a base 21 that is at least substantially circular in a plane perpendicular to the axis of the tube and protrusions 22 capable of being housed in the attachment accessory 8. A groove 23 arranged in the protrusions allows the locking by a clip of the attachment accessory. Alternatively, other blocking means are provided in order to hold the first portion in an attachment accessory.

The circular base supports a first finger-shaped axial extension 24, and a second axial extension 25, in this instance identical to the first axial extension. The circular base also supports a third axial extension 26.

An axial extension is capable of bearing a portion of the torque of the actuator, for example the torque of the actuator divided by the number of axial extensions therefore a third of the torque of the actuator. It is likewise capable of supporting a portion of the weight of the complete product (actuator plus winding tube, plus winding element), for example half of this weight divided by the number of axial extensions.

The first axial extension comprises a first screw through-hole 27 and the second axial extension comprises a second screw through-hole 28.

The circular base comprises a through-recess 29 designed to allow the free axial passage of an electric connector through the first portion.

Figure 4:
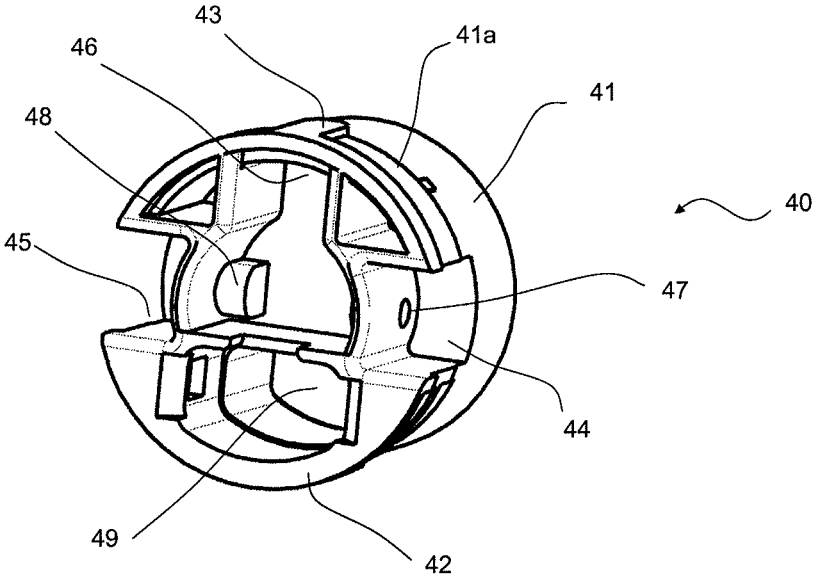
FIG. 4 represents a first embodiment of a second fixed point portion.

FIG. 4 represents a first embodiment of a second fixed point portion 40.

The second portion comprises a cylindrical body 41 capable of being engaged in the tube 3, either in direct contact with the latter, or by arranging a space just sufficient to insert an insulation tube (not shown) necessitated by the electrical insulation of control means comprised in the tube of the actuator. The cylindrical body comprises at least one internal ring 41*a* with a diameter equal to the internal diameter of the tube 3 in order to necessitate a tight sleeve-fit. An external ring 42 protrudes from the internal ring. Its diameter is for example equal to the external diameter of the tube 3. The outside of the external ring is pressed against the circular base of the first part.

A blocking means 43 is made by an axial extension of the external ring in the direction of the tube 3 and having a shape that matches that of the orifice 33.

The second portion comprises a first peripheral recess 44 and a second peripheral recess 45. It also comprises a non-peripheral recess 46. These recesses have a shape that matches the axial extensions of the first part, so as to allow interlocking with no clearance (or with reduced clearance) of the axial extensions 24-26 in the recesses 44-46.

Two tapped holes 47-48 are designed to receive the screws 37-38.

A second through-recess 49 is designed to allow the axial passage of an electric connector through the second portion, facing the first through-recess. A seal may be placed in the second through-recess.

Figure 5:
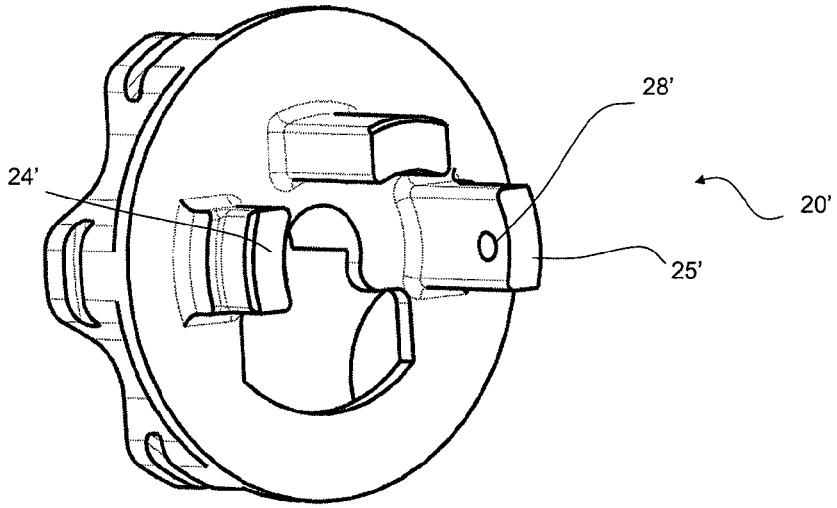
FIG. 5 represents a second embodiment of a first fixed point portion.

FIG. 5 represents a second embodiment of a first fixed-point portion 20'.

The second embodiment differs from the first embodiment only in the length of the first or of the second axial extension, in this instance the first axial extension 24', shorter than the first axial extension 24 of the first embodiment, so as not to be traversed by the first screw 37. The second axial extension 25' of the second embodiment is identical to the second axial extension of the first embodiment and therefore comprises a second screw through-hole 28' traversed by the second screw 38.

Figure 6:
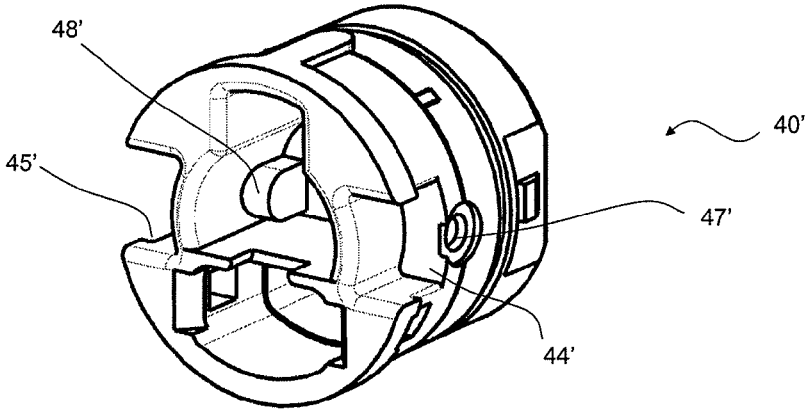
FIG. 6 represents a second embodiment of a second fixed point portion.

FIG. 6 represents a second embodiment of a second fixed-point portion 40'.

The second portion comprises a first peripheral recess 44' and a second peripheral recess 45' and it differs from the second portion of the first embodiment only in the axial length of the first peripheral recess 24', shorter than the first peripheral recess 44 of the first embodiment, so that the first screw hole 34 is not opposite the first peripheral recess 44'.

Two tapped holes 47' and 48' are designed to receive the screws 37-38.

The result of FIGS. 5 and 6 is that, in the second embodiment, the first screw 37 makes it possible to lock in translation only the second portion with the tube, while the second screw 38 makes it possible to simultaneously lock the first and the second portion with the tube. This may be an advantage relative to the first embodiment in which the two screws have the same role of simultaneous locking of the two portions of the tube.

Specifically, the first screw 37 may be furnished with a first special head requiring a tool that is available only to the manufacturer of the actuator, while the second screw may be furnished with a second special head, requiring a tool shared by the manufacturer of the actuator and the manufacturer (or manufacturers) of windable elements.

It is therefore possible to control the interchangeability of the first fixed point portions, in the best safety conditions.

Figure 8:
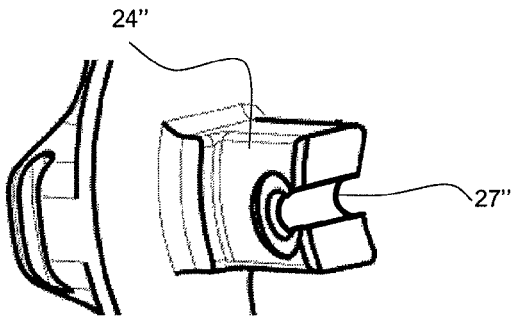
FIG. 8 represents in partial view a variant of the second embodiment of a first fixed-point portion.

In a variant of the second embodiment, shown in partial view in FIG. 8, for the first axial extension 24", a length is retained that is equal to that of the first axial extension 24 of the first embodiment, but the first screw through-hole 27 is converted into an axial orifice 27" opening at the end of the first axial extension towards the tube. Therefore, the first part is not locked in translation by the first screw, and the first axial extension nevertheless retains a maximum of material in order to satisfy the requirements of bearing torque and weight.

A third embodiment has, as the only differences with the first embodiment, the following elements:

the first portion comprises a first axial extension comprising a first hole (corresponding to the first screw through-hole 27) that is tapped to receive a first screw and a second axial extension comprising a second hole (corresponding to the second screw through-hole 28) tapped to receive a second screw;

the second portion comprises two clearing holes (corresponding to the two holes 47 and 48) designed to receive the ends of the first and second screws; preferably, the ends of these screws are engaged in the holes without being screwed into the latter. In particular, only the tip of the screw enters these holes.

A fourth embodiment has, as the only differences with the second embodiment, the following elements:

the second axial extension comprises a hole (corresponding to the second screw through-hole 28') tapped to receive a screw;

the second portion comprises a clearing hole (corresponding to the hole 48) designed to receive the end of the screw mentioned in the previous point; preferably, the end of this screw is engaged in the hole without being screwed into the latter. The end of the screw may be threaded but is preferably smooth.

A variant of the fourth embodiment has, as the only differences with the variant of the second embodiment, the following elements:

the second axial extension comprises a hole (corresponding to the second screw through-hole 28') tapped to receive a screw;

the second portion comprises a clearing hole (corresponding to the hole 48) designed to receive the end of the screw mentioned in the previous point; preferably, the end of this screw is engaged in the hole without being screwed into the latter.

The various embodiments and variants may be combined. For example, the first portion may comprise a first axial extension comprising a first hole tapped to receive a first screw and a second axial extension comprising a second clearing hole to receive a second screw, the second portion comprising a first clearing hole designed to receive the end of the first screw and comprising a second tapped hole to receive the end of the second screw. Alternatively, the screws screwed into the first portion may be non-emerging and therefore not penetrate the holes of the second portion. The holes of the second portion are then not necessary.

Throughout this document, "tapping" should be understood to be a shaping made by a tap in a hole, but also as a shaping produced by a self-tapping screw in a hole, the tapping then not being carried out before a first screwing of the screw into the hole.

Preferably, the tube 3 is tightly mounted onto the second portion of the fixed-point.

The invention claimed is:

1. An installation, wherein the installation comprises an accessory to be secured on a building and a tubular actuator for driving a windable element in the building, wherein the tubular actuator comprises:

in a tube having a longitudinal axis, a reduction gear and an output shaft at a first end of the tube and a fixed-point in two portions at a second end of the tube the fixed point being mechanically linked to the building via the accessory, wherein the fixed-point comprises:

a first portion partially outside the tube and partially inside the tube and a a second portion assembled in the tube, wherein the first portion partially outside the tube is secured to the accessory, wherein the first portion comprises at least one torque and weight-bearing axial extension, wherein the torque and weight-bearing axial extension is capable of being inserted into at least one recess of the second portion and is locked in translation along the longitudinal axis relative to the tube of the actuator by a first locking means.

2. The installation according to claim 1, wherein the first locking means is attached to the first portion.

3. The installation according to claim 2, wherein the first locking means comprises a screw, a tapping in the first portion, a screw through-hole in the second portion and a screw through-hole in the tube.

4. The installation according to claim 1, wherein the first locking means is attached to the second portion.

5. The installation according to claim 4, wherein the first locking means comprises a screw (37), a tapping (47) in the second portion, a screw through-hole (27) in the first portion and a screw through-hole (35) in the tube.

6. The actuator according to claim 1, wherein the second portion (40') is locked in translation along the longitudinal axis relative to the tube of the actuator by a second locking means (37; 47') attached to the second portion.

7. The actuator according to claim 6, wherein the second locking means does not lock the translation along the longitudinal axis of the first portion relative to the tube of the actuator.

8. The actuator according to claim 7, wherein the second locking means comprises a screw (37), a tapping (47') in the second portion, a screw through- hole (35) in the tube and, if necessary an open axial orifice (27") for a screw to pass through in the first portion.

9. The actuator according to claim 6, wherein the second locking means comprises a screw (37), a tapping (47') in the second portion, a screw through- hole (35) in the tube and, if necessary an open axial orifice (27") for a screw to pass through in the first portion.

10. The installation according to claim 1, wherein the at least one recess is a peripheral recess.

* * * * *